United States Patent [19]

Cappel et al.

[11] Patent Number: 4,502,386

[45] Date of Patent: Mar. 5, 1985

[54] INK FOUNTAIN HAVING TEMPERATURE RESPONSIVE ELEMENT

[75] Inventors: Bert Cappel, Muhlheim; Helmut Kerber, Rodermark; Siegfried Schuhmann, Offenbach am Main; Gerd Steiner, Heusenstamm, all of Fed. Rep. of Germany

[73] Assignee: M.A.N.-ROLAND Druckmaschinen Aktiengesellschaft, Offenbach am Main, Fed. Rep. of Germany

[21] Appl. No.: 494,172

[22] Filed: May 13, 1983

[30] Foreign Application Priority Data

May 13, 1982 [DE] Fed. Rep. of Germany ..... 3218045

[51] Int. Cl.[3] ..... B41F 31/04; B41F 31/06; B41L 27/08

[52] U.S. Cl. ..... 101/350

[58] Field of Search ..... 101/350, 363, 351, 364, 101/365, 207–210, 148; 118/667, 666, 261; 15/256.51

[56] References Cited

U.S. PATENT DOCUMENTS

| | | | |
|---|---|---|---|
| 1,469,544 | 10/1923 | Swaim | 101/364 |
| 1,539,202 | 5/1925 | Owen | 101/157 |
| 2,887,049 | 5/1959 | Mueller | 101/364 |
| 2,948,217 | 8/1960 | Witt | 101/364 |
| 3,134,126 | 5/1964 | Phillips | 15/256.51 |
| 3,659,553 | 5/1972 | Tobias | 118/261 |
| 3,690,254 | 9/1972 | Krochert | 101/350 |
| 3,696,743 | 10/1972 | Johne et al. | 101/365 |
| 3,779,165 | 12/1973 | Abendroth et al. | 101/365 |
| 3,855,927 | 12/1974 | Simeth | 101/350 |
| 3,888,173 | 6/1975 | Ritzerfeld | 101/350 |
| 3,895,575 | 7/1975 | Cappel et al. | 101/363 |
| 3,913,479 | 10/1975 | Cappel et al. | 101/365 |
| 3,922,966 | 1/1975 | Despot | 101/350 |
| 3,978,788 | 9/1976 | Cappel et al. | 101/363 |
| 4,000,694 | 1/1977 | Schroder | 101/365 |
| 4,024,834 | 5/1977 | Carter | 118/667 |
| 4,051,782 | 10/1977 | Fernandez | 101/365 |
| 4,236,483 | 12/1980 | Davis et al. | 101/363 |
| 4,318,341 | 5/1982 | Pietsch et al. | 101/365 |
| 4,328,748 | 5/1982 | Schramm | 101/365 |
| 4,350,095 | 9/1982 | Simeth | 101/365 |
| 4,357,872 | 11/1982 | Simeth et al. | 101/350 |

FOREIGN PATENT DOCUMENTS 1942732 1/1971 Fed. Rep. of Germany .

*Primary Examiner*—J. Reed Fisher

*Attorney, Agent, or Firm*—Leydig, Voit, Osann, Mayer & Holt, Ltd.

[57] ABSTRACT

An ink fountain for a printing press has a temperature-responsive element for compensating the adjustment of the spacing between the blade and the fountain roller to keep the thickness of the ink film fed by the blade substantially constant even under extreme temperature variations. The sub-frame of the ink fountain is pivotally mounted to the main frame of the printing press about a pivot axis generally parallel to the axis of the fountain roller, and the pivot angle is a function of the thermal expansion of the temperature-responsive element. In one preferred embodiment, the temperature-responsive element is elongated, received in a guide fixed to the sub-frame, and has a free end bearing against the bearing bushing of the fountain roller. In another embodiment, the temperature-responsive element is a side wall of the ink trough or is a plate parallel to the side wall of the ink trough, and rollers are journaled to the temperature-responsive element and bear against the surface of the fountain roller. In either embodiment, the temperature-responsive element is pre-stressed by a pull rod tending to pivot the sub-frame so that the temperature-responsive element bears against the sub-frame and the main frame.

19 Claims, 4 Drawing Figures

INK FOUNTAIN HAVING TEMPERATURE RESPONSIVE ELEMENT

BACKGROUND OF THE INVENTION

This invention relates to an ink fountain for printing machines in which the ink dispensing elements are pivotally mounted with respect to the fountain roller so as to provide an adjustment of the ink density across all of the printing zones.

Printing presses commonly employ an ink fountain in which ink is metered by a fountain blade having a precisely adjusted spacing with respect to the surface of a fountain roller. Details of the blade construction and adjusting means are provided, for example, in Cappel et al. U.S. Pat. No. 3,978,788 issued Sept. 7, 1976, herein incorporated by reference.

The ink trough in an ink fountain is defined by the surface of a fountain roller and by a sub-frame which, in some designs, is pivotally mounted to the sidewalls of the main frame of the printing press. In Cappel et al. U.S. Pat. No. 3,978,788, for example, the sub-frame is pivotally mounted so that end plates secured to the sub-frame may bear against respective ends of the sub-frame and respective ends of the fountain roller. The end plates, in other words, form the sides of the ink trough and provide sealing with respect to the fountain roller. In Simeth et al. U.S. Pat. No. 4,357,872, the sub-frame is pivotally mounted to the main frame and the pivot connection has an eccentricity so that the spacing between the blade and fountain roller may be periodically enlarged to promote the diversion of contaminated ink so as to prevent clogging.

In Hans Johne et al. U.S. Pat. No. 3,696,743 (corresponding to West German Pat. No. 1,942,732) the sub-frame of an ink fountain is pivotally and eccentrically mounted to provide means for adjusting the spacing between the blade and the fountain roller for all of the printing zones. This kind of mechanism is useful in color printing to adjust the relative densities of the primary colors.

SUMMARY OF THE INVENTION

The applicants have discovered that in practice diurnal temperature variations cause substantial variations in the thickness of the layer of ink fed to the fountain roller by the fountain blade. Thus, it should be possible to noticeably improve printing quality if this undesirable effect of temperature could be eliminated.

Accordingly, the primary object of the present invention is to provide means for keeping the thickness of the layer of ink fed to the fountain roller substantially constant even under extreme temperature variations.

Another object of the invention is to provide means for temperature compensation which are easy to adjust after assembly.

Briefly, according to the invention an ink fountain for a printing press has a temperature-responsive element for compensating the adjustment of the spacing between the blade and the fountain roller to keep the thickness of the ink film fed by the blade substantially constant even under extreme temperature variations. The sub-frame of the ink fountain, for example, is pivotally mounted to the main frame of the printing press about a pivot axis generally parallel to the axis of the fountain roller, and the pivot angle is a function of the thermal expansion of the temperature-responsive element.

In one preferred embodiment, the temperature-responsive element is elongated, received in a guide fixed to the sub-frame, and has a free end bearing against the bearing bushing of the fountain roller. In another embodiment, the temperature-responsive element is a side wall of the ink trough or is a plate parallel to the side wall of the ink trough, and rollers are journaled to the temperature-responsive element and bear against the surface of the fountain roller. In either embodiment, the temperature-responsive element is preferably prestressed, for example, by a pull rod tending to pivot the sub-frame so that the temperature-responsive element bears against the sub-frame and the main frame.

BRIEF DESCRIPTION OF THE DRAWINGS

Other objects and advantages of the invention will become apparent upon reading the attached detailed description and upon reference to the drawings in which.

While the invention has been described in connection with certain preferred embodiments, it will be understood that the applicants do not intend to be limited to the particular embodiments shown but intend, on the contrary, to cover the various alternative and equivalent forms of the invention included within the spirit and scope of the appended claims.

Modes For Carrying Out The Invention

Figure 1:
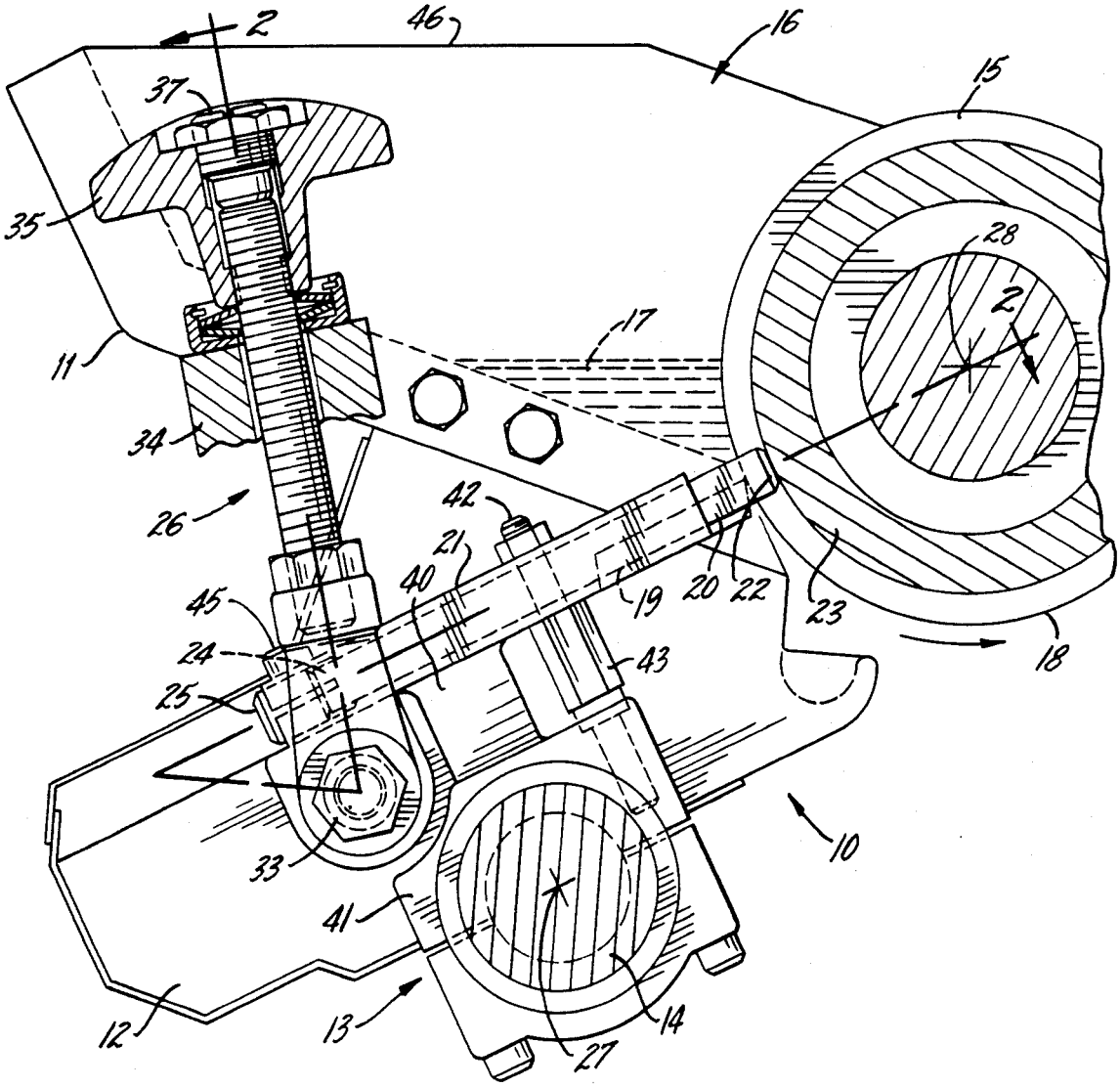
FIG. 1 is a side elevation of a first embodiment using an elongated temperature-responsive element disposed in the plane of the fountain blade.

Turning now to FIG. 1 there is shown an ink fountain having a sub-frame 10 which includes an upper trough portion 11 and a lower or base portion 12. The base portion 12 has a bearing 13 at each of its lateral ends for journaling the sub-frame 10 to a shaft 14 fixed to the machine frame. The upper trough portion 11 in conjunction with the fountain roller 15 defines a trough 16 for the containment of ink 17. The fountain roller 15 is slowly rotated so that a layer of ink is picked up and conveyed on the peripheral surface 18 of the fountain roller. To precisely adjust the thickness of the ink layer conveyed by the fountain roller 15, a fountain blade 19 is carried in the sub-frame 10 and is closely spaced from the peripheral surface 18 of the fountain roller. Suitable means (not shown) are provided for adjusting the position of the blade 19 with respect to the lower portion 12 of the sub-frame 10 at a plurality of zones laterally spaced across the length of the blade 19 and the fountain roller 15. Remote control means for performing the zonal adjustment are disclosed, for example, in Cappel et al. U.S. Pat. No. 3,978,788 issued Sept. 7, 1976, herein incorporated by reference.

The applicants have discovered that in practice diurnal temperature variations cause substantial variations in the thickness of the layer of ink fed to the fountain roller 15 by the fountain blade 19. The variation in thickness is approximately 1 to 1.5 micrometers per degree Celsius. Although this variation is small in magnitude, it is substantial in comparison to the nominal thickness of the ink layer and leads to a noticeable change in printing quality during the extreme diurnal temperature variations that occur in practice. The variation in the thickness of the ink layer as a function of temperature is primarily due to differential thermal expansion of dissimilar materials making up the components of the ink fountain, and to a lesser extent due to the change in ink viscosity as a function of temperature.

In accordance with the invention, means responsive to temperature are provided for adjusting the spacing between the fountain blade 19 and the surface 18 of the fountain roller 15 to keep the thickness of the ink film fed by the blade substantially constant even under extreme temperature variations. The required degree of adjustment per degree Celsius is determined for a particular ink fountain by means of simple experiment. The ink density on the printed product is measured, for example, at the extremes of the diurnal temperature variation. The required adjustment of the fountain blade 19 for compensating the variation in ink density is then determined from the known relation between the blade adjustment and the resulting ink density. This adjustment, in terms of micrometers, is divided by the range of temperature to determine the required adjustment per degree Celsius. For conventional printing presses, for example, the required adjustment is approximately 1 to 1.5 micrometers, the larger adjustment being required, for example, for larger ink fountains.

In accordance with an important aspect of the present invention, the temperature compensation is performed by a temperature-responsive element having a coefficient of linear thermal expansion and an effective length which compensates the spacing between the fountain blade 19 and fountain roller 15 by the required amount as a function of temperature. By "temperature-responsive element," it is meant that the element has a coefficient of linear thermal expansion substantially different than the average coefficient of linear thermal expansion for the ink fountain. In other words, the temperature-responsive element must be of a sufficiently dissimilar material than the material generally making up the ink fountain so that the thermal expansion of the temperature-responsive element can compensate for tempreature variations.

Typically the ink fountain is generally made of iron or steel alloy having a relatively low coefficient of linear thermal expansion on the order of 11 to 12 parts per million per degree Celsius. Thus, the temperature-responsive element should have a coefficient of linear thermal expansion substantially different than the coefficient of linear thermal expansion for steel. Aluminum, for example, has a coefficient of linear thermal expansion of about 21 to 24 parts per million per degree Celsius. Brass also has a relatively high coefficient of about 21 parts per million per degree Celsius. Thus, the use of a non-ferrous temperature-responsive element of aluminum or brass provides a differential thermal expansion on the order of 10 parts per million per degree Celsius for temperature compensation of the spacing between the fountain blade 19 and the fountain roller 15. If, for example, the differential thermal expansion of the temperature-responsive element by one micrometer tends to compensate the spacing between the blade 19 and roller 15 by one micrometer, then the effective length or linear dimension of the temperature-responsive element may be calculated by dividing the required compensation per degree Celsius by the differential coefficient of linear expansion for the temperature-responsive element. Assuming that an aluminum or brass element is used having a differential coefficient of 10 parts per million per degree Celsius, the required length or linear dimension is calculated as:

$$(1.0 \text{ micrometer per } ^\circ\text{C.})/(10\times 10^{-6} \text{ per } ^\circ\text{C.}) = 10 \text{ centimeters}$$

In practice, the required length or linear dimension of an aluminum or brass temperature-responsive element is about seven centimeters to 12 centimeters.

In accordance with a first exemplary embodiment shown in FIG. 1, the temperature-responsive element 20 is an elongated bar or rod of brass or aluminum. The temperature-responsive element 20 is received in a guide 21 fixed to the lower portion 12 of the sub-frame 10. The element 20 is free to expand within the guide 21 and has a free end 22 abuting against the outer periphery of a bearing bushing 23 concentric with the fountain roller 15. The second end 24 of the temperature-responsive element 20 is received in the guide 21 and abuts against a set screw 25 threaded to the guide 21. A pull rod generally designated 26 tends to rotate the sub-frame 10 clockwise about the pivot axis 27 so that the temperature-responsive element 20 bears against the bearing bushing 23 and the set screw 25. Since the set screw 25 is fixedly secured to the sub-frame 10, and the bearing bushing 23 is fixedly secured to the machine frame (not shown), the pivot angle of the sub-frame 10 about the pivot axis 27 with respect to the machine frame is a function of the differential linear thermal expansion of the temperature-responsive element 20. The pivot axis 27 is generally parallel to the axis 28 so that the pivoting of the sub-frame 10 uniformly adjusts the spacing between the fountain blade 19 and the surface 18 of the fountain roller 15 along the length of the blade 19. Since the temperature-responsive element and the fountain blade 19 are disposed at the same angular position with respect to the fountain roller 15, a unit of differential linear thermal expansion of the element 20 results in the same unit of change in the spacing between the blade 19 and roller 15. Thus, according to the previously described calculation, the length of the element 20 should be about seven to 12 centimeters.

Figure 2:
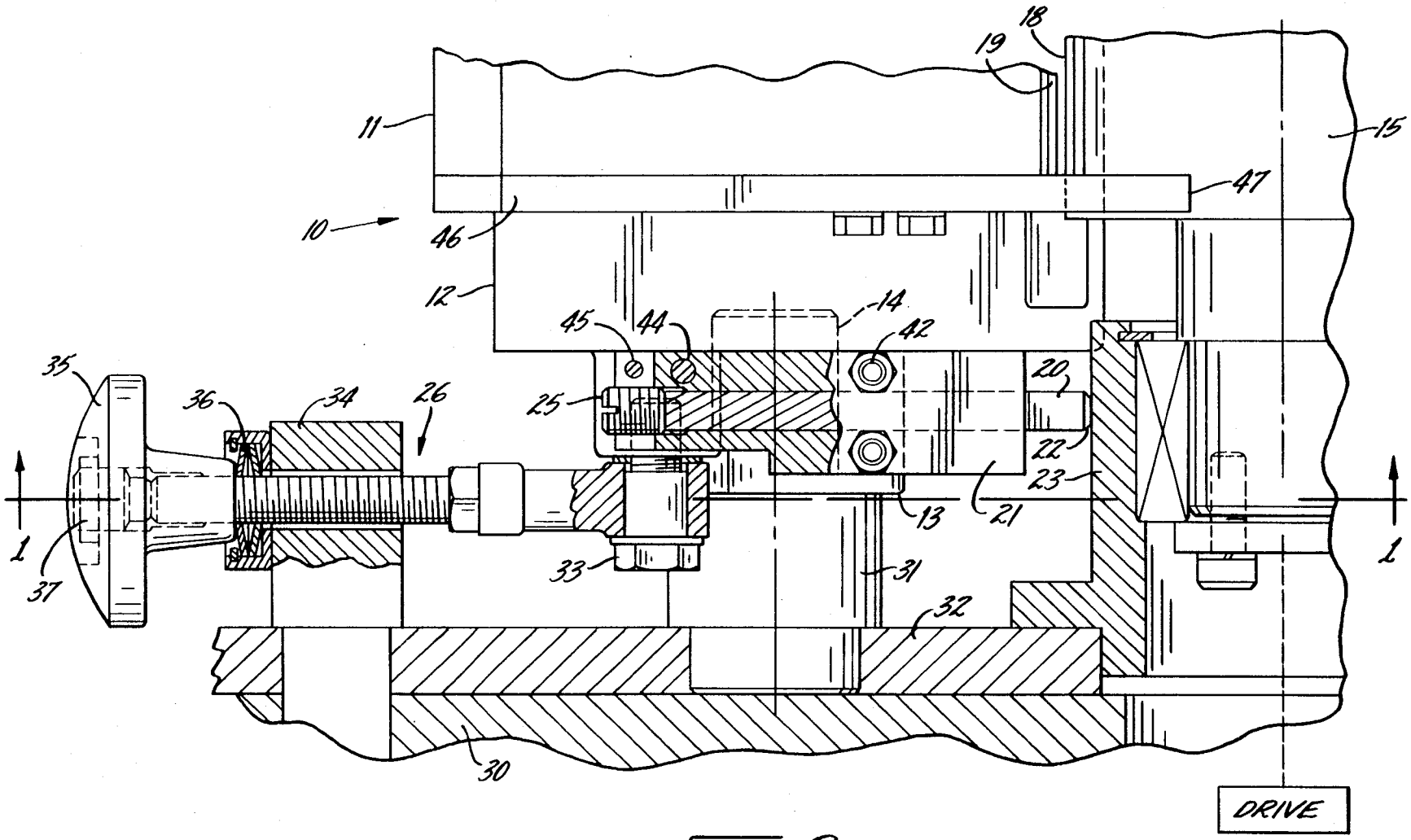
FIG. 2 is a plan view of FIG. 1 showing an abutment for mounting the pull rod and the interconnection of the abutment, bearing bushing, and pivotal mount to the main frame.

Further details of construction for the embodiment of FIG. 1 are shown in FIG. 2. It should be noted that the components shown in FIG. 1 and FIG. 2 are components disposed at one of the lateral ends of the fountain roller 15. It is understood, however, that for precise and stable mounting and pivoting of the sub-frame 10 with respect to the machine frame 30, the parts shown in FIG. 1 and FIG. 2 are duplicated at each lateral end of the fountain roller 15.

As shown in FIG. 2, it is convenient to use a shaft 14 formed in a stud 31 which is received, for example by a shrink fit, in a plate 32 fixedly secured to the machine frame 30. The bearing bushing 23, for example, is also received in the plate 32. Hence, the plate 32 functions as a side frame for the ink fountain. Alternatively, the shaft 14 could extend from one side of the machine frame 30 to the other.

The pull rod 26 has a first end pivotally attached to the sub-frame 10 and has a second end that is threaded and is supported by an abutment 34 fixedly attached to the machine frame 30 and plate 32. The second end receives a threaded handle 35 and a pair of cup springs 36 is inserted between the handle 35 and the abutment 34 to tension the pull rod 26. In other words, the pull rod 26 is resiliently mounted and supported on the side parts 30, 32, of the printing machine in order to press the temperature-responsive element against the cylindrical surface of the bearing bushing 23 at a constant force. During assembly or repair, the cup springs 36 are biased to a preset value of force by turning down the knob 35. The adjustment of the knob 35 is locked in the region of the cup springs 36 by a jamming screw or bolt 37.

To ensure that the guide 21 is securely fixed to the sub-frame 10, the guide 21 is mounted on a gusset 40 integral with an upper part 41 of the bearing 13. The guide 21 is bolted to the upper bearing portion 41 via studs 42 upon standoffs 43. A third bolt 44 secures the rear portion of the slide 21 to the casting which is integral with the gusset 40. The rear of the guide 21 is slotted so that a locking screw 45 may jam the set screw 25. In practice, the set screw 25 is adjusted so that the side plate 46 does not bear against the peripheral surface of the fountain roller 15. Furthermore, the set screw 25 is adjusted so that the tension of the pull rod 26 compressibly biases the temperature-responsive element 20 instead of the side wall 46. Thus, there is a slight gap between the side wall 46 and the peripheral surface of the fountain roller 15. In order to contain the ink 17 shown in the trough 16 of FIG. 1, the surface of the side plate 46 adjacent the peripheral surface of the fountain roller 15 is covered by a strip of felt 47.

Figure 3:
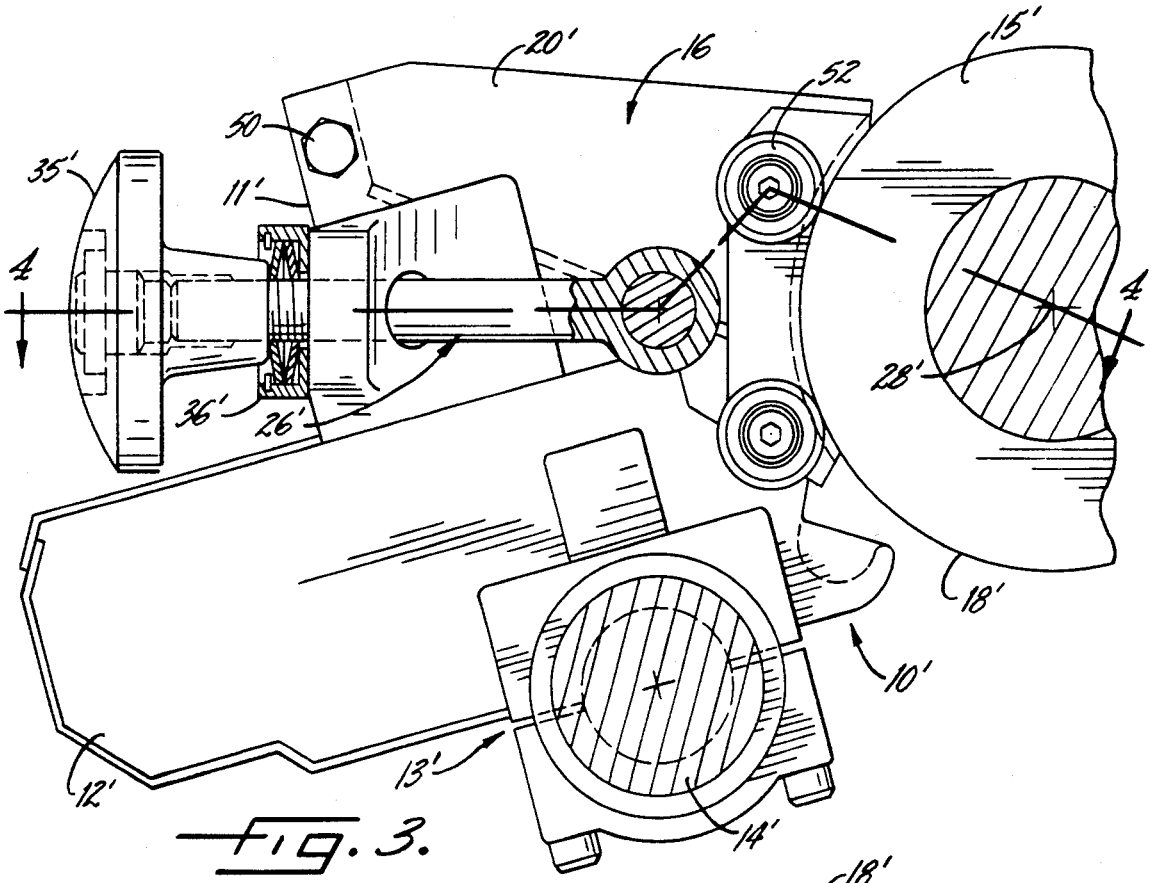
FIG. 3 is a side elevation of a second embodiment wherein the temperature-responsive element is a plate parallel to the side wall of the ink trough and has rollers which bear against the surface of the fountain roller.
Figure 4:
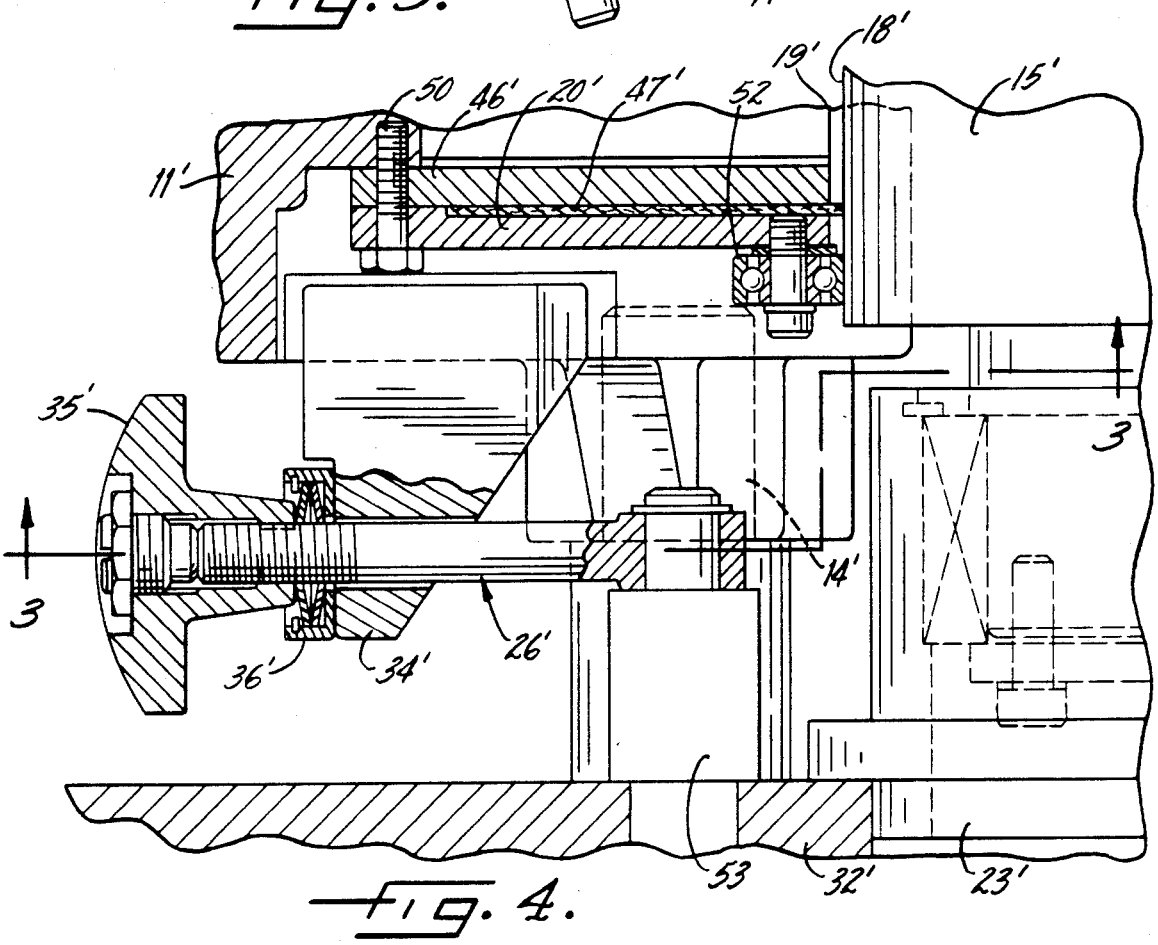
FIG. 4 is a plan view of FIG. 3 showing an abutment for mounting the pull rod and further showing a felt insert functioning as an ink seal and also as a barrier to heat conduction.

A second embodiment of the invention is shown in FIGS. 3 and 4. Compnents in the second embodiment that are similar to the components in the first embodiment are designated with identical but primed reference numerals. In the second embodiment, the temperature-responsive element is a plate 20' parallel to the side wall 46' of the ink trough 16'. A bolt 50 secures the temperature-responsive element 20' to the rear of the upper part 11' of the sub-frame 10'. The temperature-responsive element extends from the bolt 50 to the surface 18' of the fountain roller 15'. A pair of abutment rollers 52 are journaled to the temperature-responsive element 20' and bear against the surface 18' of the fountain roller 15'. The abutment rollers 52 have ball bearings to reduce the frictional drag. It should be noted that the first embodiment of FIGS. 1 and 2 does not have a problem with frictional drag because the temperature-responsive element 20 bears against the fountain roller bearing bushing 23 which is stationary.

In the second embodiment of FIGS. 3 and 4, a strip of felt 47' not only seals the ink trough, but it also separates the temperature-responsive element 20' from the side wall 46'. The felt 47' serves as a thermal insulation barrier so that the temperature of the temperature-responsive element 20' tends to track the temperature variations of the supporting components at the lateral end of the fountain roller 15' such as the side plate 32' of the ink fountain. In practice there are significant temperature variations from one side of the ink fountain to the other, so that the supporting components on the left side of the ink fountain, the ink trough itself, and the components on the right side of the ink fountain are at different temperatures. Thus, the temperature-responsive element 20' is preferably at the temperature of the other component in FIGS. 3 and 4 which effect the spacing between the blade 19' and the surface 18' of the fountain roller 15'. It should be noted, however, that for the sake of simplicity the ink trough side wall 46' could function as the temperature-responsive element in which case the abutment rollers 52 would be journaled directly to the side wall 46'. The side wall 46' should then be made of non-ferrous material such as brass or aluminum having a linear coefficient of thermal expansion substantially greater than the linear thermal coefficient of expansion for steel. But the temperature difference from one side of the ink fountain to the other is more substantial than the temperature difference between the side wall 46' and the temperature-responsive element 20', so that it is strongly recommended that separate temperature-responsive elements are used at each lateral end of the fountain roller 15'. Thus, the components shown in FIGS. 3 and 4 should be used at each end of the fountain roller 15'.

The second embodiment of FIGS. 3 and 4 also shows an alternative arrangement for the pull rod 26'. In contrast to the arrangement shown in FIGS. 1 and 2, the pull rod 26' in FIGS. 3 and 4 is pivotally secured to a stud 53 secured to the side plate 32' and the other end of the pull rod 26' bears against an abutment 34' secured to the lower part 12' of the sub-frame 10'. As in the first embodiment of FIGS. 1 and 2, the pull rod 26' in FIGS. 3 and 4 tends to pivot the sub-frame 10' so that the temperature-responsive element 20' bears against the sub-frame 10' and the main frame or side plate 32'. Note that the temperature-responsive element 20', by bearing against the fountain roller 15', bears against the main frame or side plate 32'. The temperature-responsive element 20', of course, is prestressed to a predetermined amount by turning down the handle 35' to bias the cup springs 36'.

From the foregoing, an ink fountain has been described having a temperature-responsive element for compensating the adjustment of the spacing between the blade and the fountain roller to keep the thickness of the ink film fed by the blade substantially constant even under extreme temperature variations. The required degree of temperature compensation is a function of the differential coefficient of linear thermal expansion for the temperature-responsive element, the relevant linear dimension or size of the temperature-responsive element, and the change in the spacing between the fountain blade and fountain roller for a unit of linear expansion of the temperature-responsive element. A first embodiment has been disclosed having an elongated temperature-responsive element mounted in a guide secured to the sub-frame of the ink fountain. In a second embodiment, the temperature-responsive element is a plate parallel to the side wall of the ink trough and having abutment rollers bearing against the surface of the fountain roller. Prestressing of the temperature-responsive element is provided by an adjustable and resiliently mounted pull rod.

What is claimed is:

1. In a printing press having a main frame, an ink fountain comprising a sub-frame mounted on the main frame and defining a trough for containment of ink, a slow-rotated fountain roller journaled with respect to the main frame in position to form one side of the trough, a fountain blade secured to the sub-frame and oriented with the tip of the blade spaced from the surface of the fountain roller, means for pivotally supporting the sub-frame on the main frame for movement about a pivot axis substantially parallel to the axis of the fountain roller so that the pivot angle of the sub-frame with respect to the main frame uniformly establishes the spacing along the length of the blade, means for adjusting the spacing between the blade and fountain roller to establish the thickness of the ink film fed by the by the blade to the surface of the fountain roller, said adjusting means including means responsive to temperature variations for adjusting the spacing between said blade and said fountain roller for maintaining a substantially constant ink film thickness fed by the blade during such temperature variations, said temperature-responsive adjusting means including a temperature-responsive element interposed between the sub-frame and main frame at a point removed from the pivot axis, said temperature-responsive element having a coefficient of linear thermal expansion and length selected to change the pivot angle and thus said blade spacing by a predetermined amount as a function of temperature so that the thickness of the ink film fed by the blade is substantially constant even under extreme temperature variations.

2. The ink fountain as claimed in claim 1 including means for prestressing the temperature-responsive element with an adjustable bias force.

3. The ink fountain as claimed in claim 2, wherein said prestressing means comprise a threaded pull rod having resilient biasing means, said pull rod being interposed between the main frame and the sub-frame.

4. The ink fountain as claimed in claim 1, wherein the temperature-responsive element is comprised of a nonferrous metal having a coefficient of linear thermal expansion substantially greater than the coefficient of linear thermal expansion for steel.

5. The ink fountain as claimed in claim 1, wherein the temperature-responsive element is fixedly attached to the sub-frame and has rollers which directly bear against the fountain roller.

6. The ink fountain as claimed in claim 5, wherein the temperature-responsive element is disposed at a side wall of the ink fountain.

7. The ink fountain as claimed in claim 1, wherein the fountain roller is journaled in a bearing bushing and the temperature-responsive element directly bears against the bearing bushing.

8. The ink fountain as claimed in claim 7, wherein the temperature-responsive element is elongated and is mounted for relative movement in a guide fixed to the sub-frame.

9. In a printing press having a main frame, an ink fountain having a sub-frame mounted to the main frame and supporting part of a trough for containment of ink, a fountain roller journaled to the main frame in position to form one side of the trough, a fountain blade carried in the sub-frame and spaced from the surface of a fountain roller, the sub-frame being pivotally mounted to the main frame about a pivot axis substantially parallel to the longitudinal axis of the fountain roller, wherein the improvement comprises, a temperature-responsive element interposed between the sub-frame and main frame and having a linear thermal coefficient of expansion greater than the linear thermal coefficient of expansion for steel, the temperature-responsive element being disposed at a lateral end of the sub-frame, and means biasing the sub-frame for urging said temperature-responsive element to bear against the main frame with the desired pressure so that the thermal expansion of the temperature-responsive element reliably regulates the pivoting angle of the sub-frame with respect to the main frame in order to provide temperature compensation for the spacing between the blade and fountain roller.

10. The ink fountain as claimed in claim 9, wherein the temperature-responsive element is disposed in substantially perpendicular relation to the axis of the fountain roller.

11. The ink fountain as claimed in claim 9, wherein the temperature-responsive element consists of the side wall of the ink fountain trough, and wherein rollers are secured to the temperature-responsive element and bear against the surface of the fountain roller.

12. The ink fountain as claimed in claim 9, wherein the temperature-responsive element is a plate externally bolted parallel to a side wall of the ink trough, and having rollers bearing against the surface of the fountain roller.

13. The ink fountain as claimed in claim 12, further comprising a felt insert secured between the temperature-responsive element and the adjacent side wall of the ink trough, the felt insert bearing against the surface of the fountain roller.

14. The ink fountain as claimed in claim 9, wherein the temperature-responsive element is an adjustable elongated element disposed in a guide generally in the plane of the fountain blade, the sub-frame being pivoted to the main frame by a shaft fixed to the main frame and a bearing receiving the shaft and fixed to the sub-frame, the guide being mounted on the bearing.

15. The ink fountain as claimed in claim 14, wherein the fountain roller is journaled within a bearing bushing and wherein the adjustable elongated element has a free end pressing against the outer periphery of the bearing bushing.

16. The ink fountain as claimed in claim 9, wherein a pull rod is secured at a first end by a pivot joint on said sub-frame and is threaded at a second end, the second end receiving a threaded handle, the second end being supported by an abutment, and at least one pair of cup springs being interposed between a surface of the abutment and a surface of the handle.

17. In a printing press having a main frame, an ink fountain comprising a sub-frame mounted to the main frame and defining a trough for containment of ink, a slowly-rotated fountain roller journaled with respect to the main frame and positioned to form one side of the trough, a fountain blade secured to the sub-frame and oriented with the tip of the blade spaced from the surface of the fountain roller, means for adjusting the spacing between the blade and the fountain roller to establish the thickness of the ink film fed by the blade to the surface of the fountain roller, the sub-frame being pivotally mounted to the main frame about a pivot axis generally parallel to the axis of the fountain roller upon two pivot shafts inwardly extending from the side walls of the main frame, the sub-frame having a bearing at each of its longitudinal ends for journaling the respective pivot shafts, the sub-frame receiving the blade and associated means for zonal adjustment of the spacing between the blade and the fountain roller, wherein each bearing has a gusset upon which a slide is mounted, the axis of the slide being approximately in a radial direction with respect to the axis of the fountain cylinder, the slide receiving an elongated temperature-responsive element having a coefficient of linear thermal expansion greater than the coefficient of linear expansion for steel, the temperature-responsive element abuting against an element fixed to the main frame, the other end of the temperature responsive element abutting against an adjustment screw threaded into the guide, each gusset being connected to a pivot joint, and wherein a pull rod applies an adjustable tension between the pivot joint and an abutment fixed to the main frame.

18. The combination as claimed in claim 17, further comprising means for locking the adjustment screw.

19. The combination as claimed in claim 17, wherein cup springs are provided to tension the pull rods, and the pull rods are threaded for adjustment and lockable in the region of the cup springs.

* * * * *